US005987818A

United States Patent [19]

Dabideen

[11] Patent Number: 5,987,818

[45] Date of Patent: Nov. 23, 1999

[54] REMOTELY CONTROLLED DOOR LOCKING AND OPENING SYSTEM

[76] Inventor: Pooran Dabideen, 321 Delaware Ave., Ft. Lauderdale, Fla. 33312

[21] Appl. No.: 09/176,638

[22] Filed: Oct. 21, 1998

[51] Int. Cl.[6] ..... E05F 15/00

[52] U.S. Cl. ..... 49/280; 292/144

[58] Field of Search ..... 49/13, 25, 279, 49/280, 300, 302; 70/278.1, 256, 257; 292/144

[56] References Cited

U.S. PATENT DOCUMENTS

| | | | |
|---|---|---|---|
| 4,334,388 | 6/1982 | Kambic | 49/13 |
| 4,907,429 | 3/1990 | Davis et al. . | |
| 5,083,448 | 1/1992 | Karkkainen et al. | 292/144 X |
| 5,095,654 | 3/1992 | Eccleston . | |
| 5,490,698 | 2/1996 | Dezso . | |
| 5,511,284 | 4/1996 | Current . | |
| 5,636,880 | 6/1997 | Miller et al . | |
| 5,678,868 | 10/1997 | Williams et al. . | |
| 5,852,944 | 12/1998 | Gollard et al. | 292/144 X |
| 5,878,530 | 3/1999 | Eccleston et al. | 49/25 X |

*Primary Examiner*—Jerry Redman
*Attorney, Agent, or Firm*—Kenneth L Tolar

[57] ABSTRACT

A wireless, remotely controlled door locking and opening system includes a door swingable from a closed position to an open position when a manual force is applied to either side thereof. A solenoid controlled deadbolt is mounted to the doorjamb for locking the swinging door. A motorized toothed-gear wheel mechanism is rotatably coupled to the swinging door for rotating the swinging door to an ajar position after the doorjamb mounted deadbolt has been retracted from the locked position. The deadbolt solenoids and the gear wheel motor are selectively activated with a remote control means.

14 Claims, 7 Drawing Sheets

80
10
DIS ARM
ARM
OPEN
LOCK
31A
50
43
31B
5
61A
62
60
61B
WELCOME

REMOTELY CONTROLLED DOOR LOCKING AND OPENING SYSTEM

BACKGROUND OF THE INVENTION

The present invention relates to a remotely controlled door locking system.

DESCRIPTION OF THE PRIOR ART

An electronic lock capable of being unlocked from a remote location for aiding the disabled has been disclosed in U.S. Pat. No. 4,907,429, issued to Davis et al., entitled "REMOTE CONTROLLED DOOR LOCK APPARATUS." The Davis et al. patent discloses a solenoid operated element for connection to a conventional door lock. The solenoid operated element is activated with a toggle or similar switch.

A further example of a remotely controlled electronic safety lock is disclosed in U.S. Pat. No. 5,490,698, issued to Dezso, entitled "DOOR LOCKING SYSTEM." The Dezso patent discloses a door locking bolt movably mounted in the door and a solenoid operated door lock striker mounted in the door frame positioned to receive the locking bolt in un-lockable engagement when the door is in the closed position. The door is automatically set to re-lock upon its opening.

Another example of a solenoid operated electronic lock is disclosed in U.S. Pat. No. 5,636,880, issued to Miller et al., entitled "ELECTRONIC LOCK." The Miller et al. patent discloses an electronic lock which includes a solenoid driven actuator and a cam actuator ring. The cam ring interfaces with both the latch of the door lock and the door lock key cylinder.

U.S. Pat. No. 5,678,868, issued to Williams et al., entitled "ELECTRONIC DOOR LOCKING MECHANISM" discloses an electronic combination lock which delivers power to a motor when a valid security code has been entered. The motor manipulates a cam-plunger which moves an actuator pin into a thumb piece. As the user applies force to the thumb piece, a latch engagement mechanism operates the door latch.

An example of a remotely controlled system which locks, unlocks and opens a door is disclosed in U.S. Pat. No. 5,095,654, issued to Eccleston, entitled "AUTOMATIC OPERATING SYSTEM FOR SWINGING DOOR." The Eccleston patent discloses a system which sequentially retracts a door-mounted deadbolt, retracts a door mounted main latch and opens the door via a hydraulic system. A drawback with the system disclosed in the Eccleston patent is that the use of the hydraulic system limits the rotation of the swinging door to only one direction and such hydraulic system is slow to open the door to the fully open position. Furthermore, the swinging door cannot be quickly returned to the closed position because the pressurized air in the hydraulic system must be released.

Another patent in the art directed to swinging doors is U.S. Pat. No. 5,511,284, issued to Current, entitled "DOOR HOLD OPEN DEVICE." The Current patent discloses a device which functions to maintain the door open in combination with a manual door closer assembly.

As will be seen more fully below, the present invention is substantially different in structure, methodology and approach from that of the prior electronic door lock systems.

SUMMARY OF THE INVENTION

The present invention relates to a wireless, remotely controlled door locking and opening system comprising: a door swingable from a closed position to an open position when a manual force is applied to either side thereof; a doorjamb mounted deadbolt for locking said swinging door; an electrically activated solenoid mechanism coupled to said deadbolt, which retracts the deadbolt from a locked position in said door to an unlocked position within the doorjamb. The device also includes a motorized toothed-gear wheel mechanism rotatably coupled to said swinging door having a maximum rotational velocity to produce a force sufficient to rotate said door to at least an ajar position after said deadbolt has been retracted to the unlocked position.

It is therefore a object of the present invention to provide a wireless, remotely controlled door locking and opening system with two solenoid operated deadbolts for automatically locking a door.

It is yet another object of the present invention to provide a wireless, remotely controlled door locking and opening system which replaces the latching mechanism of a conventional door with a motorized toothed-gear wheel mechanism to automatically open the door from a remote location.

It is yet another object of the present invention to provide a time delay means to open the door within a predetermined duration after the dead bolt has been unlocked.

A further object of the present invention is to provide a wireless, remotely controlled door locking and opening system which includes a radio frequency receiver responsive to a radio frequency transmitter to activate the solenoid mechanisms and motorized toothed-gear wheel mechanism from a remote location.

It is a further object of the present invention to provide a wireless, remotely controlled door locking and opening means with an alarm system to alert a user if the door is opened by an unauthorized individual.

It is a still further object of the present invention to provide the wireless, remotely controlled door locking and opening system with a braking means for halting the rotation of the motorized toothed-gear wheel mechanism.

In view of the above objects, it is a feature of the present invention to provide a wireless remotely controlled door locking and opening system which is simple to manufacture.

The above and other objects and features of the present invention will become apparent from the following drawings, the description given herein, and the appended claims.

DESCRIPTION OF THE PREFERRED EMBODIMENT

Figure 1:
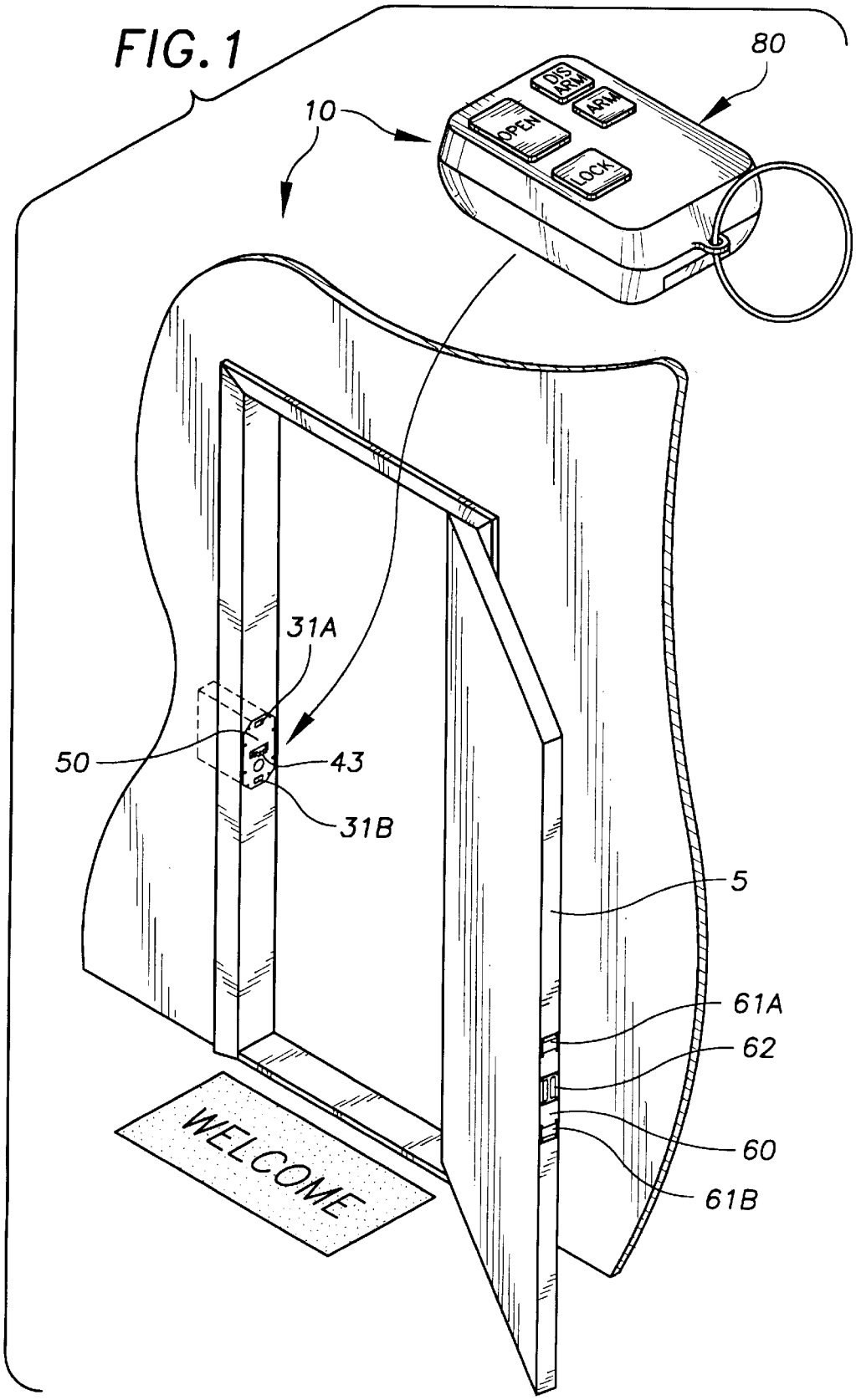
FIG. 1 illustrates a perspective view of the wireless, remotely controlled door locking and opening system of the present invention installed on a swinging door.

Referring now to FIGS. 1 through 8, the wireless, remotely controlled door locking and opening system of the present invention is designated generally by the numeral 10. The system includes a locking sub-assembly 30 comprising first and second solenoid operated deadbolts 31A and 31B coupled with first and second electrically operated solenoids 32A and 32B via translating rod members 33A and 33B, respectively. The exemplary embodiment includes two deadbolts with one mounted in the doorjamb above the other. However, any number of deadbolts may be used without departing from the spirit of the present invention.

Since the operation of the first and second deadbolts 31A and 31B and their respective solenoids 32A and 32B is identical, only one such solenoid operated deadbolt will be described in detail. When radio receiver 20 receives a locking signal from remote radio transmitter 80, the signal immediately activates first solenoid 32A. First solenoid 32A causes translating rod member 33A to extend first deadbolt 31A from the unlocked position within the doorjamb through a doorjamb plate 50 and into a locked position into door 5. First deadbolt 31A remains in the locked position in door 5 until radio receiver 20 receives an unlocking/opening control signal from the remote radio transmitter 80. At that time, first solenoid 32A retracts its corresponding translating rod member 33A, which retracts first deadbolt 31A from the locked position in door 5 to its original unlocked position.

The system also includes a door opening sub-assembly 40 comprising a doorjamb mounted motorized toothed-gear wheel mechanism 43 which is provided in the place of a conventional door latching mechanism. Rotation of the wheel mechanism 43 applies force to the edge of door 5 opposite the hinges to rotate door 5 to at least an ajar (slightly open) position.

Door opening sub-assembly 40 further comprises a DC motor 41 with a drive shaft 46 having a flywheel 42 and a magnetic clutch 45 coupled thereto. The clutch is in communication with the radio receiver 20 via a time delay circuit 44. Upon receipt of an unlocking/opening control signal, the DC motor 41 is activated simultaneously with solenoids 32A and 32B thereby causing the drive shaft to rotate. Within a predetermined time thereafter, the time delay circuit 44 activates the magnetic clutch 45 to drive the attached wheel mechanism 43. Accordingly, the drive shaft will have sufficient momentum to rotate the wheel mechanism 43 with sufficient force to open door 5.

A braking means 47, including an electrically operated solenoid 48, a braking rod 49 and time delay circuit 47A, stops toothed-gear wheel mechanism 43 after a second predetermined time delay. The second delay is longer than the first delay so that the braking means 47 stops the wheel mechanism 43 after the wheel mechanism 43 has finished opening door 5. The braking means 47 stops the rotation of the wheel mechanism 43 after the second time delay by extending braking rod 49 into one of the gaps between adjacent teeth of the wheel mechanism 43. The braking means 47 also supplements the deadbolts by engaging and disengaging the wheel mechanism 43 when the locking sub-assembly 30 is set to the locked and unlocked positions, respectively.

Figure 2:
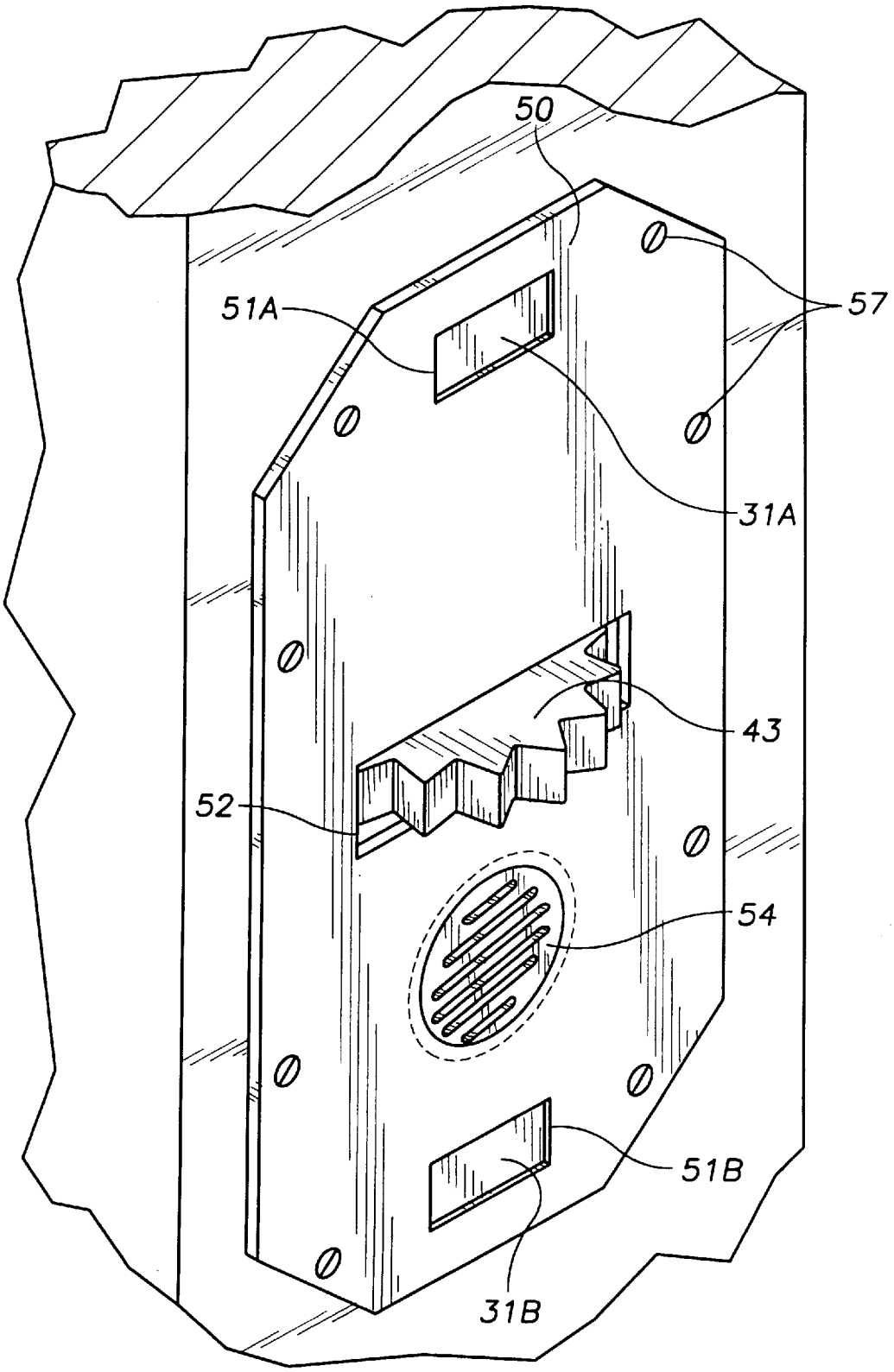
FIG. 2 illustrates a perspective view of the doorjamb plate of the present invention mounted to a doorjamb with the deadbolts in the unlocked position.
Figure 3:
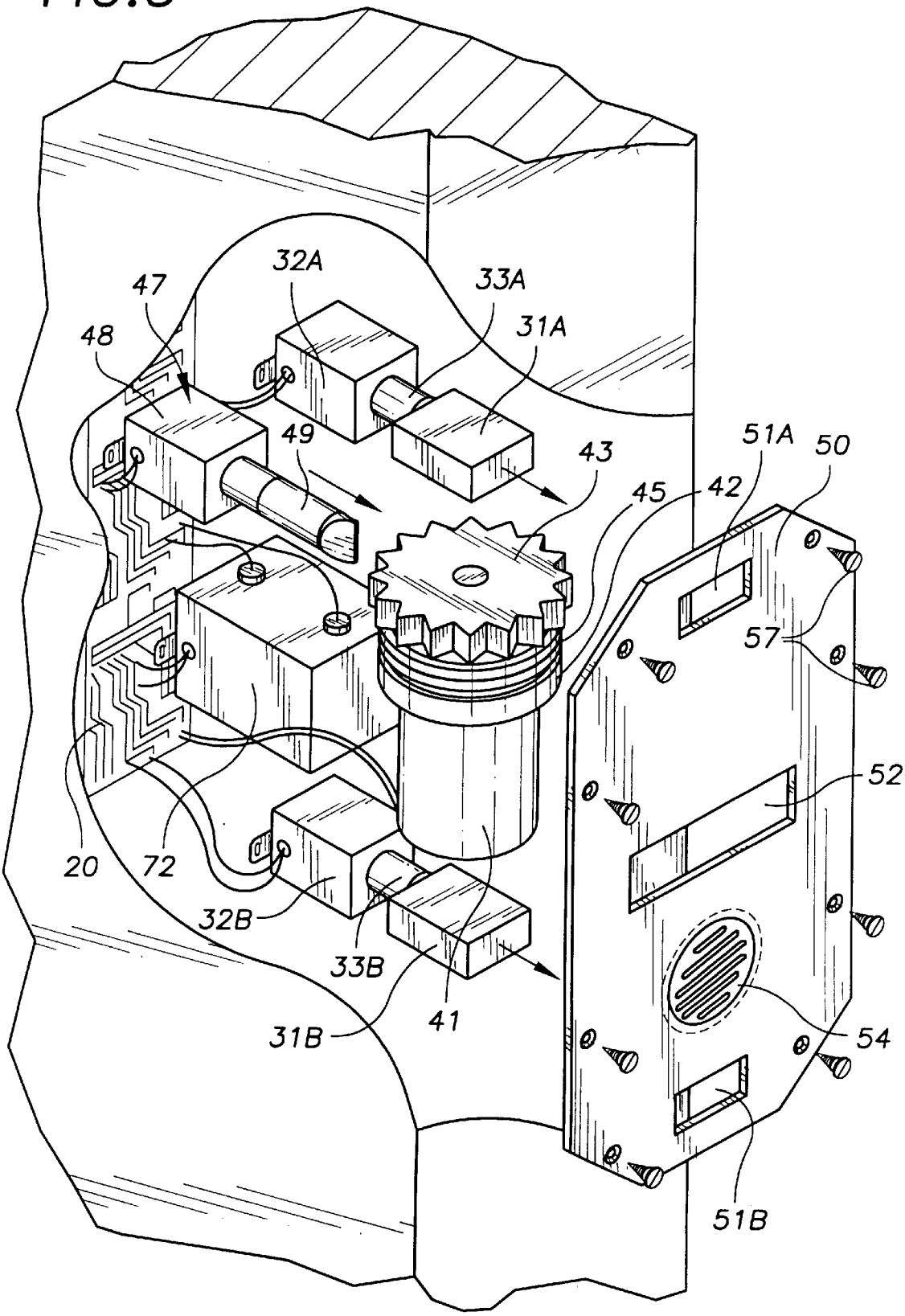
FIG. 3 illustrates an exploded view of the doorjamb mounted components according to the present invention.

As illustrated in FIG. 2, doorjamb plate 50 is dimensioned to fit on a doorjamb and is secured thereto with a plurality of securing means 57, such as screws. The doorjamb plate 50 has formed therein a top deadbolt aperture 51A, a bottom deadbolt aperture 51B, a center slot 52 and a speaker means 54. The top and bottom deadbolt apertures 51A and 51B are dimensioned and positioned to slidably receive deadbolts 31A and 31B, respectively. The center slot 52, formed between top and bottom deadbolt apertures 51A and 51B, is dimensioned to receive therethrough the teeth of wheel mechanism 43 such that its rotation is not hindered.

Referring now to FIG. 1, door 5 is a freely swinging door which is adapted to swing in either of the two directions as a force is manually applied to door 5 from either side thereof. If deadbolts 31A and 31B are in the unlocked position and a predetermined amount of force is manually applied to door 5 from either side thereof, the wheel mechanism 43 rotates to allow door 5 to rotate in either direction. However, when door 5 is opened electronically via remote radio transmitter 80, the wheel mechanism 43 only rotates in one direction and door 5 is therefore swung to the ajar (open) position in only one of the two directions.

A door plate 60 is dimensioned to fit on the side edge of door 5 and is secured thereto in a conventional manner. The door plate 60 has formed therein top and bottom deadbolt apertures 61A and 61B which are aligned with top and bottom deadbolt apertures 51A and 51B, respectively, of doorjamb plate 50. Door 5 has formed therein corresponding recesses aligned with apertures 61A and 61B for the receipt of deadbolts 31A and 31B, respectively.

The door plate 60 further includes shafts 62 which are engaged by wheel mechanism 43 when the wheel mechanism is rotated. The shafts 62 fit between adjacent gear teeth to retain the door 5 in a closed position until a predetermined amount of force is applied thereto or the wheel mechanism is activated.

The power source 70 for the system comprises an electrical plug 71 including a power transformer and battery means 72. Electrical plug 71 is designed to be coupled to a conventional 110V AC wall outlet. In the preferred embodiment, battery means 72 is a rechargeable Ni-cad battery for providing an auxiliary power source in the event that AC power is unavailable. Battery means 72 is electrically coupled to electrical plug 71 via male/female connector 73 for continuously recharging the battery means.

Figure 6A:
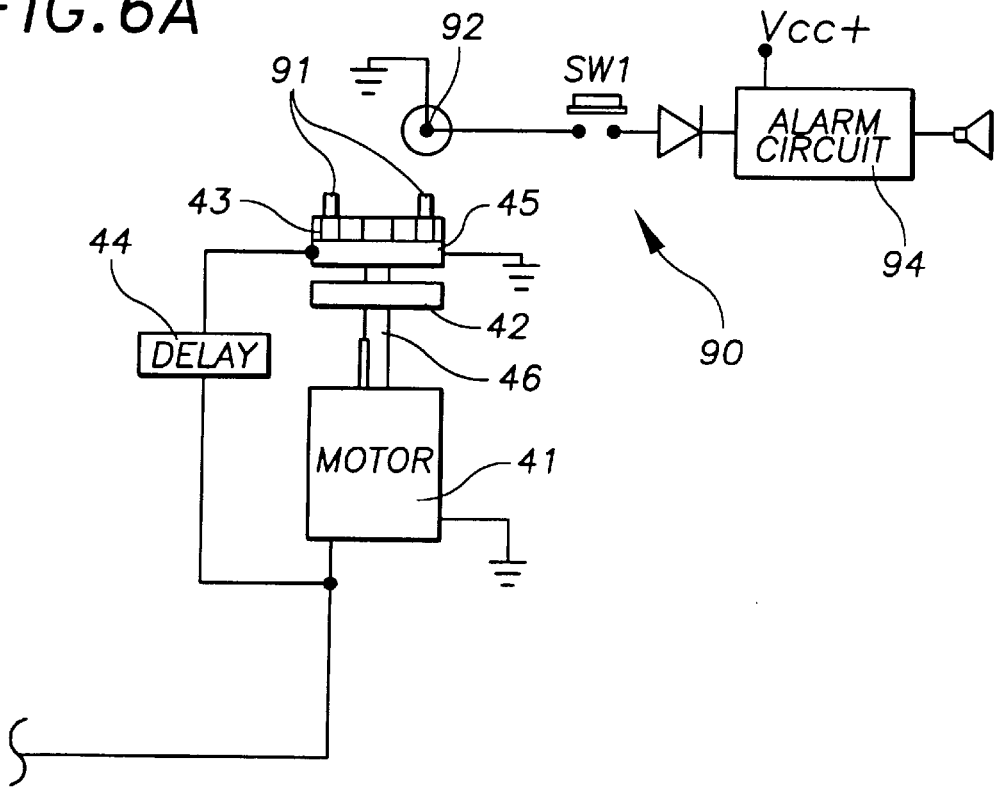
FIG. 6A is a block diagram of an optional alarm means for use with the embodiments of FIGS. 4 and/or 5.
Figure 6B:
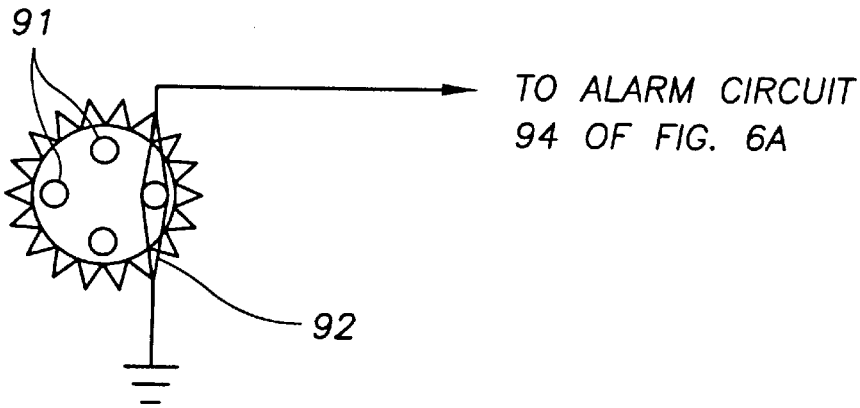
FIG. 6B illustrates a partial top view of the alarm means.

Referring now to FIGS. 6A and 6B, an alarm means 90 is depicted. Alarm means 90 comprises a plurality of spaced magnets 91 secured to the top face of the wheel mechanism 43. A magnetic reed switch 92 is mounted proximal the top face of the wheel mechanism 43 and is in communication with an alarm circuit 94, on/off switch 100 and a speaker 54. In the preferred embodiment, there are four magnets spaced at 90° intervals, however, they may be spaced at any desired interval without departing from the spirit of the present invention.

In operation, when on/off switch 100 is closed, alarm means 90 is armed. When door 5 is opened, the wheel mechanism 43 and the attached magnets 91 are rotated, thereby activating the magnetic reed switch 92 and thus the alarm means 90. As can be appreciated, the alarm means 90 may serve as a burglar alarm or as a means for alerting a visually impaired person that a person has entered the room.

Figure 4:
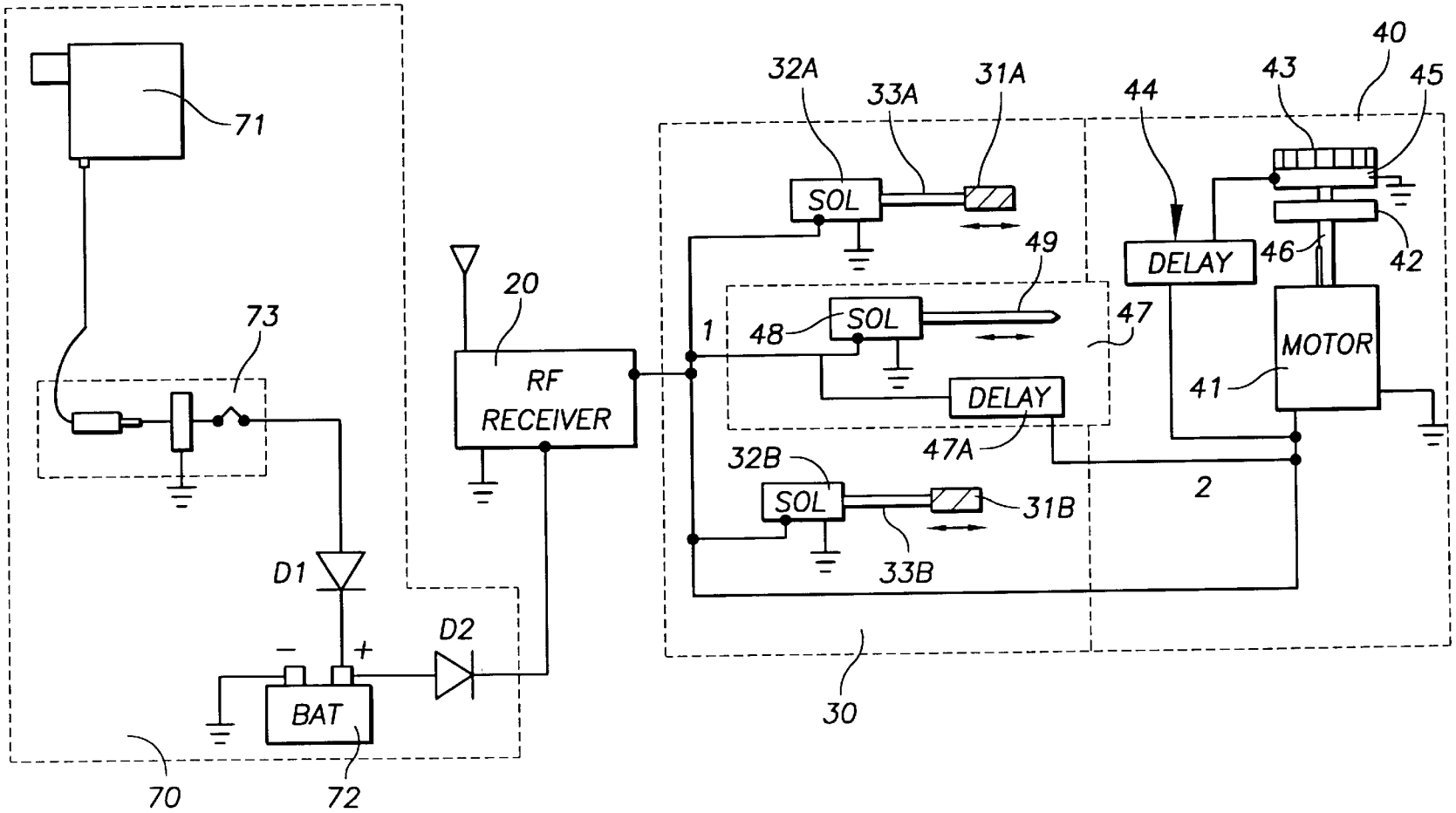
FIG. 4 is a block diagram of the wireless, remotely controlled door locking and opening system providing sequential unlocking and opening operations.
Figure 7:
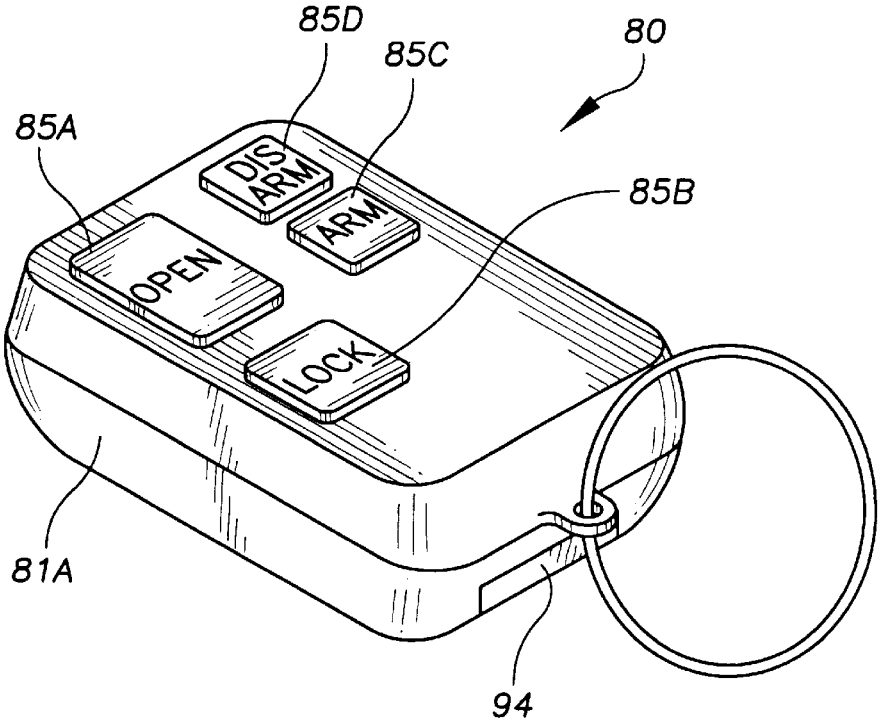
FIG. 7 illustrates a perspective view of a remote radio transmitter for use with the embodiment of FIG. 4.

FIGS. 4 and 7 depict the embodiment wherein the door is sequentially unlocked and opened in response to a single signal from the remote radio transmitter 80. Button 85A of the radio transmitter 80 is used to transmit an unlock/open signal to radio receiver 20 to sequentially unlock and open door 5 via the locking 30 and door opening 40 sub-assemblies, respectively. Button 85B causes locking sub-assembly 30 to lock swinging door 5 by extending deadbolts 31A and 31B into door 5. Additionally, when alarm sub-assembly 90 is provided, buttons 85C and 85D serve to respectively arm and disarm the alarm.

Figure 5:
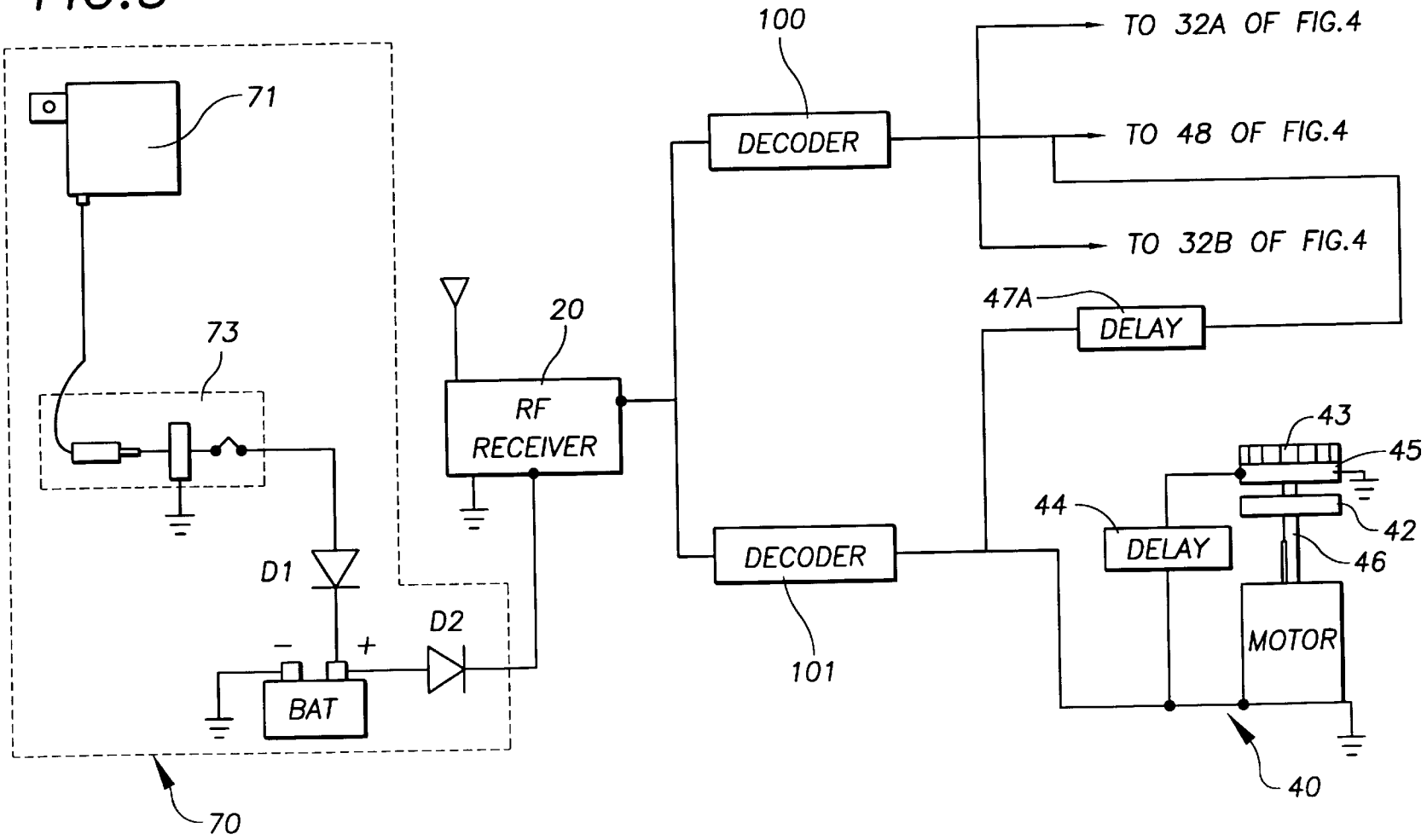
FIG. 5 illustrates a block diagram of an alternate embodiment of the wireless remotely controlled door locking and opening system providing independent unlocking and opening operations.
Figure 8:
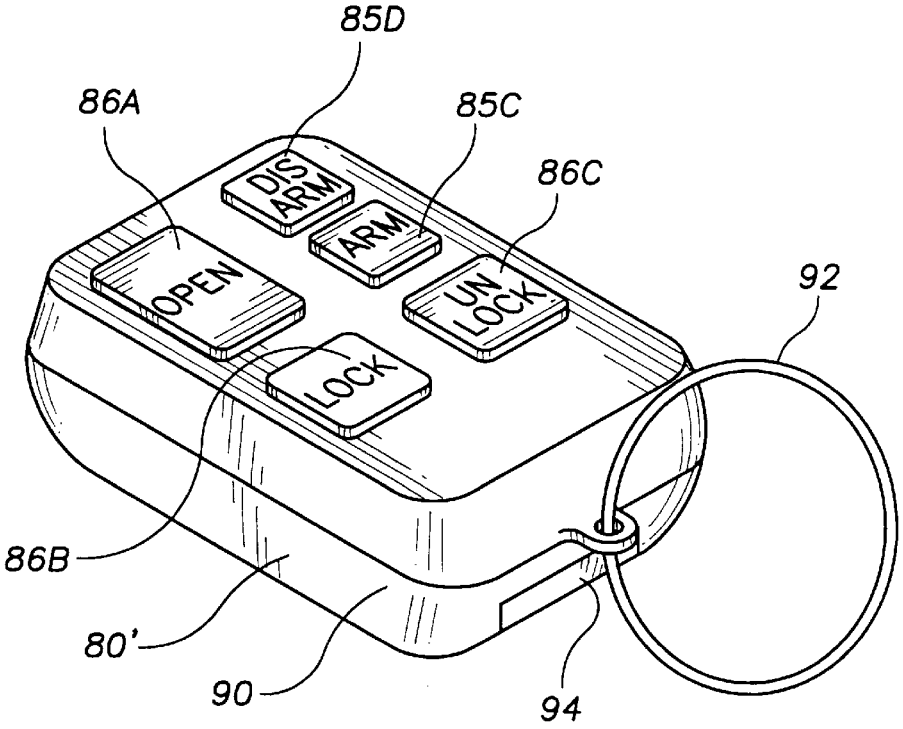
FIG. 8 illustrates a perspective view of a remote radio transmitter for use with the embodiment of FIG. 5.

Referring now to FIGS. 5 and 8, a second embodiment is depicted wherein the locking sub-assembly 30 and the door opening sub-assembly 40 are independently operated via a remote radio transmitter 80'. Buttons 86B and 86C transmit signals to decoder 100 to lock and unlock door 5, respectfully. Button 86C transmits a signal to second decoder 101 to activate the door opening sub assembly 40. Additionally, when an alarm means 90 is provided, buttons 85C and 85D serve to arm and disarm alarm means 90.

Radio transmitters 80 and 80' preferably include a housing 90 having a key ring 92 attached thereto. The housing 90 includes a battery door 94 for permitting access to batteries (not shown).

It is noted that the embodiment of the wireless remotely controlled door locking and opening system described herein in detail, for exemplary purposes, is of course subject to many variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In combination with a doorjamb including a door swingable from a closed position to an open position when a manual force is applied to either side thereof, a remotely controlled door locking and opening system comprising:

a deadbolt mounted to said doorjamb for locking said swinging door;

an electrically activated solenoid mechanism coupled to said deadbolt, which extends and retracts said deadbolt between a locked position received within said door and an unlocked position received within said doorjamb;

a motorized toothed-gear wheel mechanism received within said doorjamb, and rotatably engaging said door and having a maximum rotational velocity to produce a force sufficient to rotate said door to at least an ajar position immediately after said deadbolt has been retracted from said locked position.

2. The system of claim 1, further comprising:

a motor means having a drive shaft for rotating said gear wheel mechanism;

a magnetic clutch coupled to said drive shaft; and, a time delay circuit electrically coupled to said magnetic clutch for delaying the operation of said magnetic clutch for a predetermined time delay.

3. The system of claim 2, further comprising a braking means for halting the rotation of said motorized toothed-gear wheel mechanism after said door has been rotated to said ajar position.

4. The system of claim 3, wherein said braking means comprises:

an electrically activated solenoid; and, a braking rod coupled to said solenoid and which is receivable in a gap between teeth of said motorized toothed-gear wheel mechanism.

5. A device according to claim 1 further comprising an alarm means for alerting a user when said door is moved to an ajar position.

6. The system of claim 5, wherein said alarm means comprises:

a plurality of spaced magnets secured to a side of said motorized toothed-gear wheel mechanism;

a magnetic reed switch mounted proximal said motorized toothed-gear wheel mechanism, said switch responsive to magnetic force variations created by said magnets as said motorized toothed-gear wheel is rotated to detect opening of said swinging door; and, a sound producing means responsive to said magnetic reed switch to emit an audible signal when said magnetic reed switch detects said opening of said door.

7. The system of claim 1, wherein said motorized toothed-gear wheel mechanism includes means for maintaining said swinging door in said closed position when said doorjamb mounted deadbolt is in said unlocked position.

8. The system of claim 1, further comprising:

a remote transmission means;

a receiver means coupled to said motorized toothed-gear wheel mechanism and said electrically activated solenoid mechanism and responsive to said transmission means to control said gear wheel mechanism and to move said dead bolt between the locked and unlocked positions;

a remote transmission means;

a receiver means in radio communication with said transmission means;

a locking means electrically coupled to said receiver means for locking and unlocking said swinging door, said locking means including a deadbolt mounted to said doorjamb for locking said door; an electrically activated solenoid mechanism coupled to said deadbolt which extends and retracts the deadbolt between a locked position, received within said door, and an unlocked position received within said doorjamb;

a door opening means electrically coupled to said radio receiver for rotating said swinging door to an open position, said door opening means including a motorized toothed-gear wheel mechanism rotatably engaging said swinging door, said wheel mechanism having a maximum rotational velocity to produce a force sufficient to rotate said door to said open position after said deadbolt has been retracted to the unlocked position.

9. The system of claim 8 further comprising a time delay means in communication with said wheel mechanism whereby said wheel mechanism is activated a predetermined time after said locking means is retracted to an unlocked position.

10. The system of claim 9, said door opening means further comprises:

a motor means having a drive shaft;

a magnetic clutch coupled to said drive shaft;

said time delay means electrically coupled to said magnetic clutch for delaying the operation of said magnetic clutch for a predetermined time.

11. The system of claim 10, further comprising a braking means for halting the rotation of said toothed-gear wheel mechanism after a predetermined duration.

12. The system of claim 11, wherein said braking means comprises:

an electrically activated solenoid;

a braking rod coupled to said solenoid that is extended and retracted thereby, said rod is receivable in a gap between teeth of said motorized toothed-gear wheel mechanism.

13. The system of claim 12, further comprising:

a plurality of magnets secured in spaced relation to a side of said motorized toothed-gear wheel mechanism;

a magnetic reed switch mounted proximal said motorized toothed-gear wheel mechanism, said reed switch responsive to magnetic force variations created by said magnets as said gear wheel is rotated to detect opening of said door;

an alarm means responsive to said magnetic reed switch to emit an audible signal when said magnetic reed switch detects said opening of said swinging door.

14. The system of claim 13, wherein said motorized toothed-gear wheel mechanism includes means for maintaining said swinging door in said closed position when said deadbolt is in said unlocked position.

* * * * *